US009221594B2

(12) United States Patent
Bushee

(10) Patent No.: US 9,221,594 B2
(45) Date of Patent: Dec. 29, 2015

(54) PACKAGING FOR COMPACT LIGHT ASSEMBLIES

(71) Applicant: Glenn Bushee, Duxbury, MA (US)

(72) Inventor: Glenn Bushee, Duxbury, MA (US)

( * ) Notice: Subject to any disclaimer, the term of this patent is extended or adjusted under 35 U.S.C. 154(b) by 389 days.

(21) Appl. No.: 13/748,361

(22) Filed: Jan. 23, 2013

(65) Prior Publication Data

US 2013/0193017 A1 Aug. 1, 2013

Related U.S. Application Data

(60) Provisional application No. 61/591,514, filed on Jan. 27, 2012.

(51) Int. Cl.

| | |
|---|---|
| ***B65D 85/42*** | (2006.01) |
| ***B65D 81/02*** | (2006.01) |
| ***B65D 5/50*** | (2006.01) |

(52) U.S. Cl.

CPC ..... *B65D 81/022* (2013.01); *B65D 5/5028* (2013.01)

(58) Field of Classification Search

CPC ..... B65D 81/022; B65D 5/5028
USPC ..... 206/418–422, 523, 587, 591–594, 701; 220/505; 211/13.1, 40, 41.12
See application file for complete search history.

(56) References Cited

U.S. PATENT DOCUMENTS

| | | | | |
|---|---|---|---|---|
| 1,713,631 | A * | 5/1929 | Tinsley | B65D 5/5014 206/418 |
| 1,986,344 | A * | 1/1935 | Koppelman | 206/419 |
| 3,035,825 | A * | 5/1962 | Weller | 206/523 |
| 3,987,956 | A * | 10/1976 | Congleton | 206/523 |
| 5,366,080 | A * | 11/1994 | Carstersen et al. | 206/523 |
| 5,585,591 | A * | 12/1996 | Waldock | F42B 39/30 206/499 |
| 7,472,789 | B2 * | 1/2009 | Wu | A61C 19/00 206/523 |
| 7,810,639 | B2 * | 10/2010 | Djulaini et al. | 206/523 |
| 2006/0076253 | A1 * | 4/2006 | Hong et al. | 206/523 |
| 2009/0045098 | A1 * | 2/2009 | Smith | 206/592 |

* cited by examiner

*Primary Examiner* — Luan K Bui
(74) *Attorney, Agent, or Firm* — Lawrence J. Shurupoff

(57) ABSTRACT

A system is disclosed for minimizing damage to a compact light assembly having a battery, a light and an on-off switch. An outer package snugly holds an inner package formed with a series of spaced-apart slots. A light assembly is snugly frictionally held in each slot to protect the light assembly from damage due to shipping and/or rough handling. The packaging system also prevents the unintended activation of the on-off switch due to rough handling.

11 Claims, 8 Drawing Sheets

PACKAGING FOR COMPACT LIGHT ASSEMBLIES

CROSS REFERENCE TO RELATED APPLICATIONS

This application claims the benefit and priority of U.S. provisional patent application Ser. No. 61/591,514 filed Jan. 27, 2012 entitled Packaging for Compact Light Assemblies and which is incorporated herein by reference in its entirety.

BACKGROUND

Compact light assemblies have been developed in the form of small wafers, some about one inch wide, two inches long and one eighth of an inch thick. These light assemblies can be used for marking positions in dark and dim light conditions, such as marking a trail at night or marking a location of a building or other object. The light assemblies can also be provided on shoes and clothing to protect joggers, bikers and others from nighttime traffic. An example of a representative compact light assembly is described in published PCT/US2011/025668, U.S. Ser. No. 13/395,612 and Publication No. US-2012-0318985-A1 and which is incorporated herein in its entirety by reference.

Each light assembly has an "on-off" button switch which can be activated by simple finger pressure. While this is most convenient for a user, it presents a problem when shipping and handling a number of light assemblies. That is, large numbers of light assemblies have previously been loosely packaged in bulk in plastic bags and cardboard boxes. Because of the rough treatment commonly encountered during shipping and handling, the light assemblies are often bumped against each other and against other packages, shelves, tables, conveyors and the like.

A common result of this rough handling is the unintended activation of one or more light assemblies, resulting from the depression of the "on-off" switch provided on each light assembly. When the "on-off" switch is bumped against another light assembly or against an external object, the light can turn on. When an end user receives a bulk package of loosely packaged light assemblies, they may find one or more of the light assemblies turned on and shining within and/or through the package. This unintended activation is undesirable, as it wastes battery life and results in consumer complaints or returned orders.

Another issue arising from loosely packaged or loosely contained light assemblies is the unintended activation of the on-off switch when one or more light assemblies are carried in one's pocket. By bumping one's pocket against a hard surface, the light assembly can turn on and shine through one's clothing. This can create a problem during law enforcement and tactical operations by giving away the location of those carrying the light assembly.

SUMMARY

In order to prevent the unintended activation of the "on-off" switch on a compact light assembly due to depression of the on-off switch caused by jostling or bumping loosely packaged or loosely contained light assemblies, a new packaging system has been developed as described below. An outer package provides a first layer of protection and an inner package provides a second layer of protection. The inner package is designed to be used alone to allow several light assemblies to be carried within the protective inner package as an integral unit, such as within a clothing pocket, pack, or other retainer or holder.

DESCRIPTION OF REPRESENTATIVE EMBODIMENTS

Figure 1:
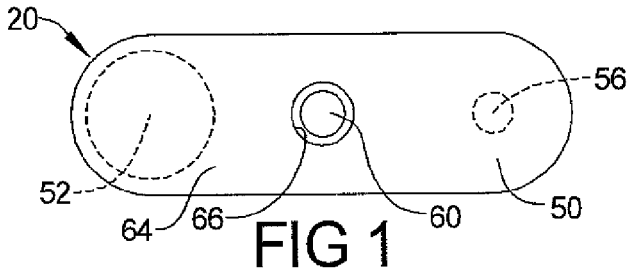
FIG. 1 is a top plan view of a first side of a light assembly.
Figure 2:
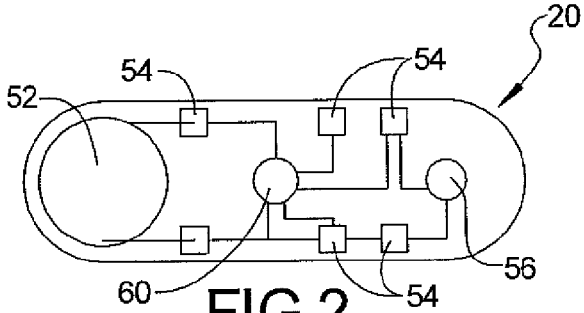
FIG. 2 is a bottom view of a second side of the light assembly of FIG. 1.

In order to fully appreciate the benefits of the packaging system described below, it is useful to understand the type of light assembly which is to be packaged therein. One embodiment of a compact, lightweight battery, light and switch assembly 20 is shown in FIGS. 1 and 2. A thin, semi-flexible, laminated, shiny, mirror-like, light-reflecting substantially planar sheet 50 of plastic acts as a platform, planar base or flat circuit board for holding a thin "button" battery 52 soldered or otherwise fixed to its front or rear surface. Sheet 50 is advantageously formed of a waterproof sheet or foil to protect microcircuitry 54 carried on platform 50. The battery 52 is electrically connected to switching microcircuitry 54 which is controlled by a user-operated button switch 56. The microcircuitry 54 can be further waterproofed with a layer of epoxy and covered by a thin sheet of rigid plastic. The rigid plastic sheet can be staked to the sheet 50 with pins or rivets to increase the strength of the laminated assembly.

In another embodiment, sheet 50 is formed with a nonreflective, black surface when the lighting assemble 20 operates with an infrared light. A flat black surface coating can be applied to planar sheet 50 to improve and enhance the detection of infrared light signatures when using an infrared viewer such as night vision goggles.

The sequential actuation of button switch 56 causes the microcircuitry 54 to apply power to a light-emitting diode (LED) or other miniature electric light 60 in various operating modes. For example, a first actuation or depression of button switch 56 can trigger circuitry 54 to apply full constant power to the LED 60 for a bright constant light. A second depression of button switch 56 can trigger circuitry 54 to apply less than fall constant power to the LED 60 for a longer-lasting low-power lighting.

Other sequential operating modes can include a rapidly strobed or pulsed light mode, a slowly strobed or pulsed light mode, a high power strobed or blinking light mode, a low power strobed or blinking light mode and a power off mode to turn off the LED light. The button switch 56 can be mounted on either the front or rear surface of the assembly 20 and is easily depressed and actuated by pressing down on any flexible covering material overlying button switch 56 or by directly pressing button switch 56, if it is exposed. As noted above, the button switch 56 can be located on either the front or rear surface of sheet 50. This allows an operator to actuate the button switch 56 from the front or rear surface of sheet 50, depending on the application or end use of lighting assembly 20.

To maximize the visible lighting emitted from the assembly 20, the reflective front surface 64 (FIG. 1) of the sheet 50 is formed with a highly reflective mirror-like surface finish or coating. This can take the form of a thin shiny metal foil or a layer of light-reflecting paint. An aperture or port 66 (FIG. 1) is formed through sheet 50 to allow for the unobstructed passage of light from LED light 60.

Figure 3:
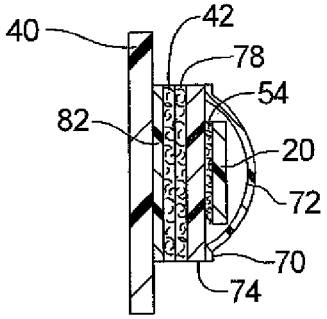
FIG. 3 is a view in section of a second embodiment of a light assembly including a detachable hook and loop mounting.

As shown in FIG. 3, the assembly 20 can be removably mounted to a surface 40 with an integral adhesive layer or, as further shown, with a hook and loop releasable fabric connection. The assembly 20 can be fitted within a pouch or flexible casing 70. Pouch 70 can be hermetically sealed around the lighting assembly 20 to protect the lighting assembly 20 from shock, vibration, exposure to ambient moisture, liquids, dust and the like. The outer surface or ply 72 of casing 70 can be coated or formed of a translucent light-reflecting plastic material such as an ANSI class 2 material or simply formed of a clear sheet of plastic. In the event the LED 60 becomes inoperative, surface 64 (FIG. 1) will still brightly reflect light from auto headlights, flashlights and the like to provide a secondary level of safety in those applications where no visible light is provided by LED 60.

As further seen in FIG. 3, the rear surface or ply 74 of casing 70 can be covered with an integral flexible hook and loop fabric material 78 of the type marketed under the brand Velcro. An attachment strip 82 of adhesive or tacky material can be permanently or removably coupled, glued, bonded, sewn, clipped or otherwise attached or coupled to a substrate such as on the front outer portion of substrate 40 as shown in FIG. 3. A strip of Velcro material 42 can then be attached to the attachment strip 82. Alternatively, the adhesive attachment strip 82 is provided as a backing on a strip of Velcro material 42 and permanently or removably attached or bonded to the outer surface of the substrate 40 for removably mounting the lighting assembly 20 to the substrate 40. Substrate 40 in FIG. 3 can represent the surface of any substrate such as a building or other structure or any article worn or carried by a person including a glove, a shoe, a vest, a shirt, a jacket, a hat, a helmet, pants, and belts.

With attachment strip 36 with Velcro material 42 in place on surface 40, casing or pouch 70 can be quickly and easily mounted and demounted from substrate 40 or any other substrate with a simple press for installation and a simple pull or peel for removal, as the hook and loop materials 78 and 42 respectively engage and disengage from each other. When the battery 52 in assembly 20 is exhausted, an operator need only remove one casing 70 with a simple pull and quickly and easily mount a fresh casing or pouch 70 onto mounting strip 36 with a simple push or press fit. The same easy mounting and demounting is afforded by the adhesive backing 82 discussed below.

Figure 4:
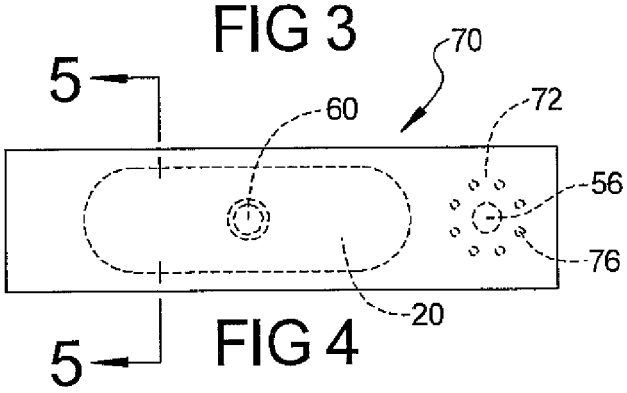
FIG. 4 is a top plan view of a light assembly provided with a removable mounting strip.
Figure 5:
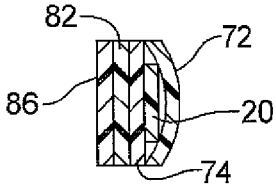
FIG. 5 is a view in cross section taken along section line 5-5 of FIG. 4 and showing a complementary adhesive mounting strip.

As seen in FIGS. 4 and 5, a hollow hermetically-sealed and waterproof casing or pouch 70 having an adhesive backing 82 is provided with a peel-off cover 86 similar to that used on adhesive bandages of the "Band Aid" variety. Cover 86 can be removed when required and casing 70 can be adhesively mounted in the manner of an adhesive strip on virtually any surface, such as to walls, floors, articles of manufacture, trees, rocks, clothing, footwear, warning signs, police, firemen and construction helmets and other "hard hats" as well as any other substrate such as those noted above.

In one embodiment, the length of the pouch or casing 70 is less than about three inches, the height of casing or pouch 70 is less than about two inches and the thickness through the pouch and assembly 20 as seen in FIG. 5 is less than about one quarter inch. The combined weight of the pouch 70 and assembly 20 of FIGS. 4 and 5 is less than 10 grams, i.e., about 5 grams. Because of the small size and weight of this lighting assembly, a dozen or more assemblies can be conveniently carried in one's pocket to mark a trail by placing a lighting assembly 20 in at least one location or in a series of space-apart locations on the ground or mark other locations as desired. One simply activates the light 60 by actuating switch 56 and placing the light assembly on a substrate at a position or location to be marked. If provided with an adhesive backing 82, the lighting assembly 20 can be pressed onto a desired substrate to be marked to hold the light assembly on a desired spot, such as a wall, a door, a tree, etc. Of course, one or more lighting assemblies 20 need not be enclosed in a pouch 70. These simpler assemblies can be simply laid on the ground or on an object to provide a low cost lighted marker.

As further seen in FIG. 4, the portion of the outer surface of pouch 70 overlying the switch 56 can be textured such as with ridges and grooves or a series of dimples 76 to enable a user to easily locate and operate switch 56 solely by tactile feel without looking at pouch 70. This is most useful when operating lighting assembly 20 in the dark.

As noted above, light assemblies 20 of the type described have been packaged in bulk, leading to the unintended activation of switch 56. In order to overcome this problem, a multicompartment inner package 100 (FIG. 6) has been developed to protect the light assemblies 20 from unintended or accidental activation, and also from physical damage due to rough handling or other physical abuse during shipping and handling.

Inner package 100 is advantageously formed of a molded and foamed plastic material such as open cell non-reticulated polyurethane foam with non-uniform random-sized cells. The foamed material forming the body of the inner package 100 can be relatively firm being of the consistency of Styrofoam packaging material. However, a somewhat softer material is preferred, such as a spongy material of the type used in scrub sponges. Alternatively, the inner package can be formed of any suitable energy absorbing or impact-absorbing deformable or crushable material such as paper or cardboard. It is also possible to use a nonwoven flocked material such as felt.

Figure 6:
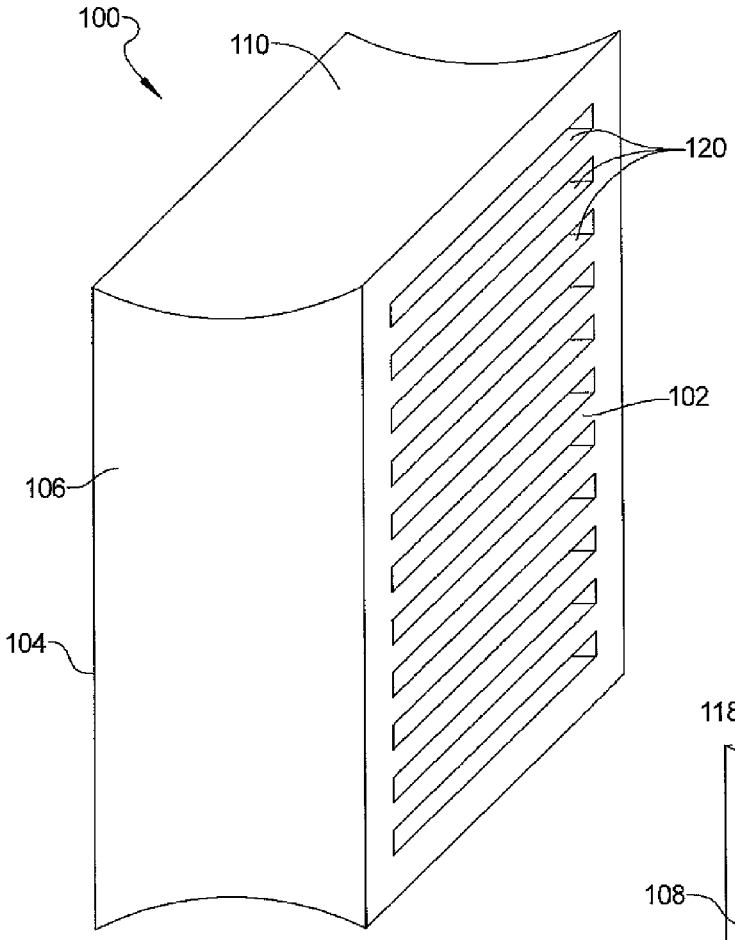
FIG. 6 is a top left perspective view of one embodiment of an inner package.

As further seen in FIG. 6, the inner package 100 can be formed in a generally cubic rectangular or brick shape. In the representative embodiment of FIG. 6, the inner package 100 has a planar rectangular front face 102, a planar rectangular rear face 104, a concave left side 106 and a concave right side 108. The top face 110 may be formed as a concave rectangular face, and the bottom face 112 may also be formed as a concave rectangular face. While concave surfaces 106, 108, 110 and 112 are preferred, these surfaces can also be formed as flat planar surfaces forming a parallelepiped or rectangular cuboid with the planar front and rear faces 102, 104.

Figure 8:
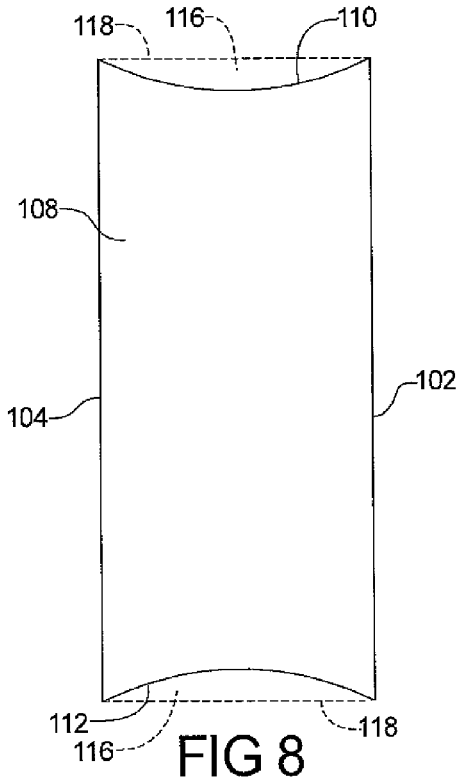
FIG. 8 is a right side elevation view of the inner package taken along line 8-8 of FIG. 7.
Figure 7:
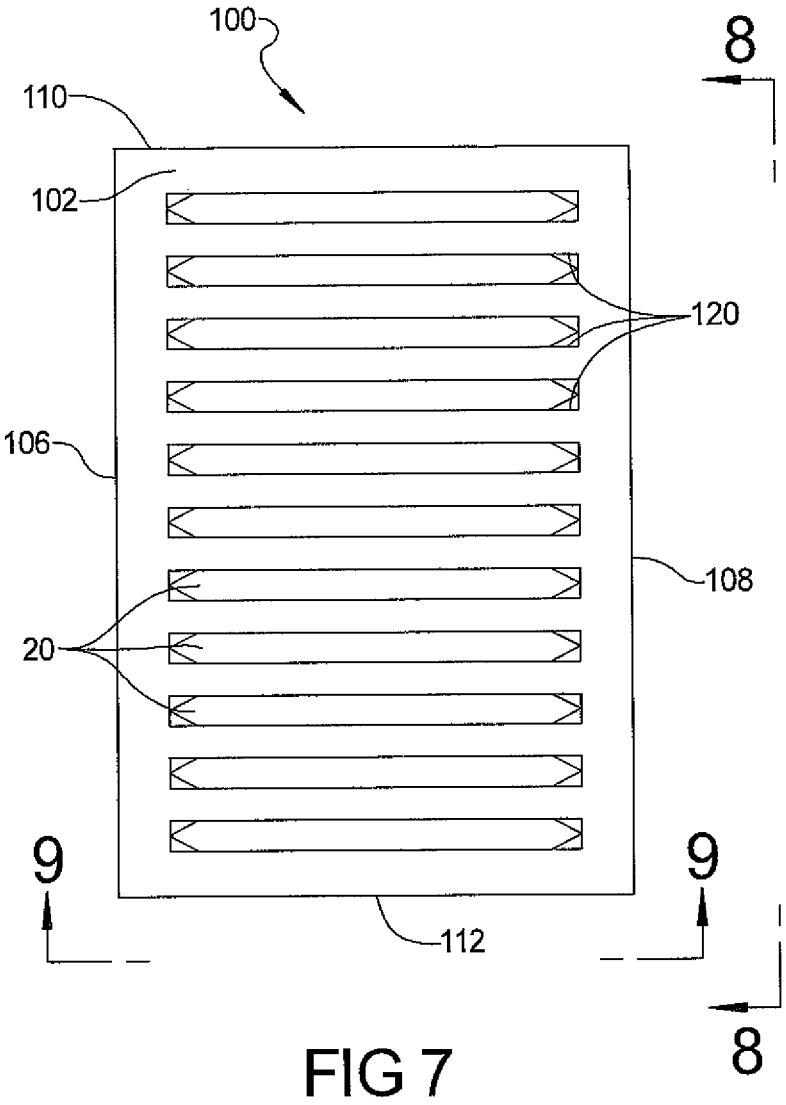
FIG. 7 is a front elevation view of FIG. 6.
Figure 9:
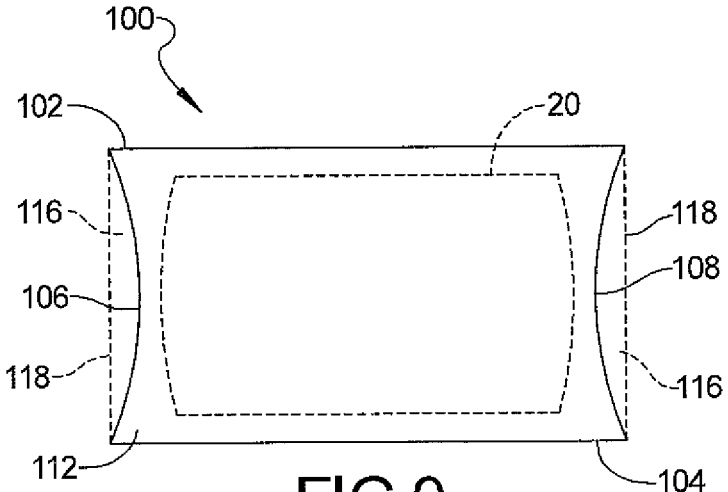
FIG. 9 is a bottom view of the inner package taken along line 9-9 of FIG. 7.

As discussed further below, the concave trough-shaped void spaces 116 (FIG. 8) formed between the front and rear walls by the concave recesses extending along the top, bottom and side walls provides crush space for receiving deformations caused by the crushing of an outer package. Two of these crush spaces 116 are shown within the dotted chord lines 118 in FIG. 8 and two more are shown in FIG. 9. The crush spaces 116 exhibit segment-like cross sections similar to a circular segment.

The inner package 100 is formed with a series of equally spaced apart openings, slits or slots 120 for receiving one or more light and switch assemblies 20. The assemblies 20 can be held within each slit or slot 120 with a light biased friction fit. This allows the assemblies 20 to be quickly and easily removed from the slits or slots 120 with a simple push and/or pull.

As seen in FIG. 9, the inner package 100 is formed with a ladder-like construction which substantially surrounds each assembly 20 to provide a soft resilient cushion of energy-absorbing material around the edges or periphery of each light assembly as well as above, underneath and between each adjacent light assembly. As can be seen in FIGS. 1-5, 7 and 9, the light assemblies are arranged in a ladder-like configuration as steps in a ladder with switches 56 facing one of the top face 110 and bottom face 112 and depressible towards the other one of the top face 110 and bottom face 112.

Figure 10:
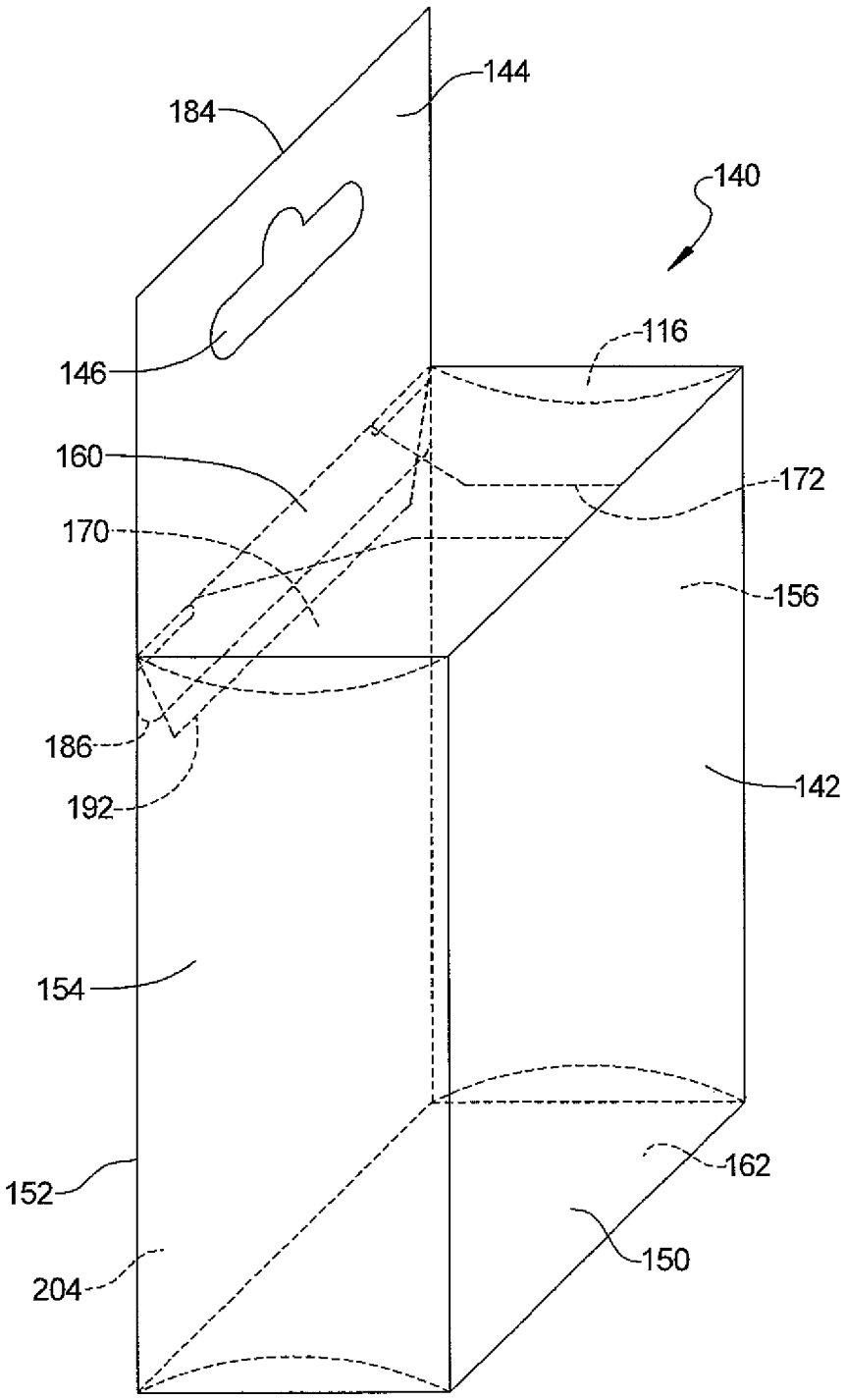
FIG. 10 is a top left perspective view of one embodiment of an outer package.

A representative outer package 140 is shown in FIG. 10. The body or container portion 142 of the outer package 140 is shown as a rectangular hollow box having an optional hang tag or mounting flap 144. Flap 144 can be formed with a perforation 146 for hanging the outer package 140 on a display rack or the like. The outer package 140 has a planar rectangular front wall 150, a planar rectangular rear wall 152, planar rectangular left and right side walls 154, 156 and a substantially flat top wall 160 and a substantially flat segmented bottom wall 162.

Figure 11:
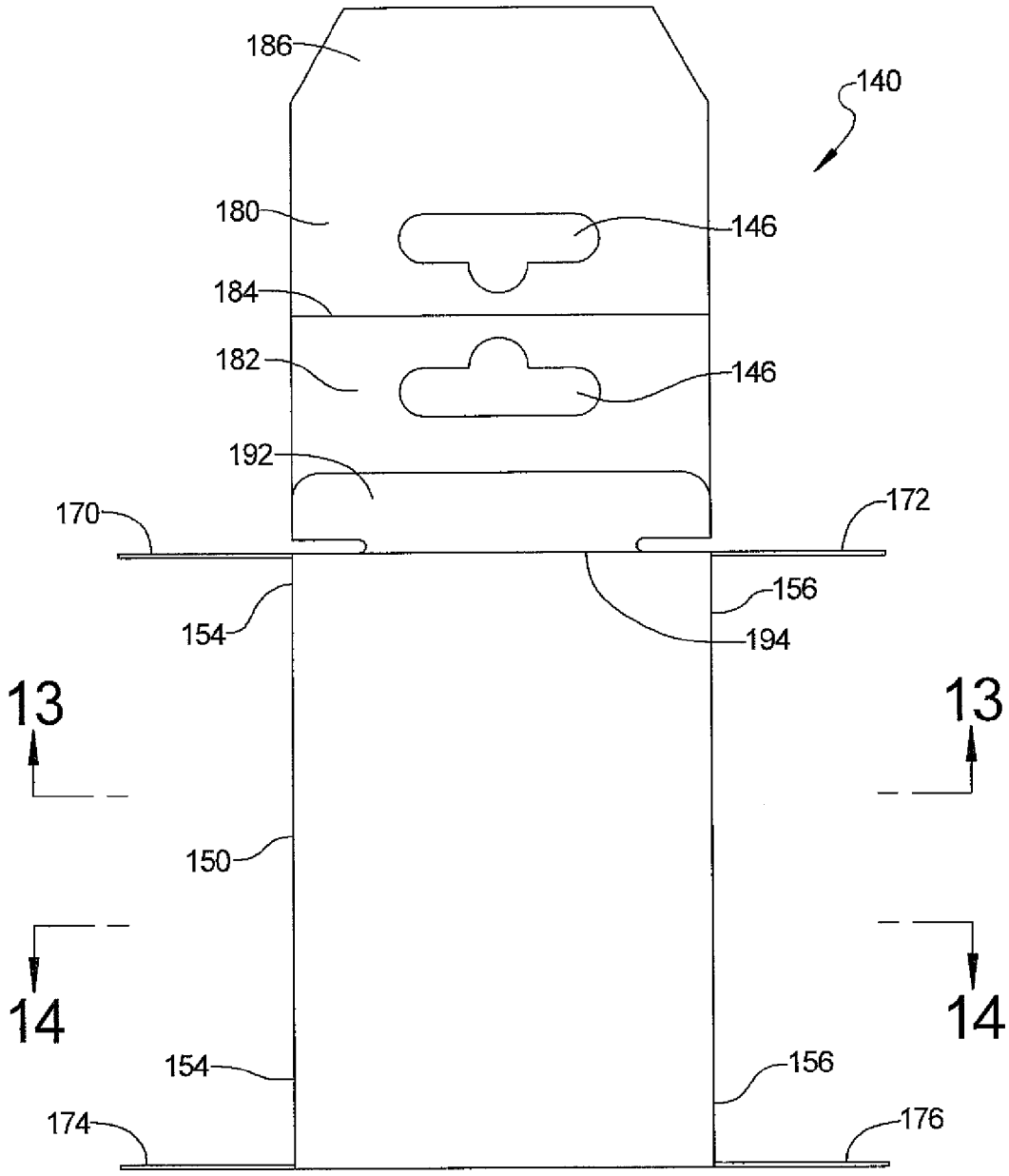
FIG. 11 is a front elevation view of FIG. 10 in a partially open or unfolded configuration.
Figure 12:
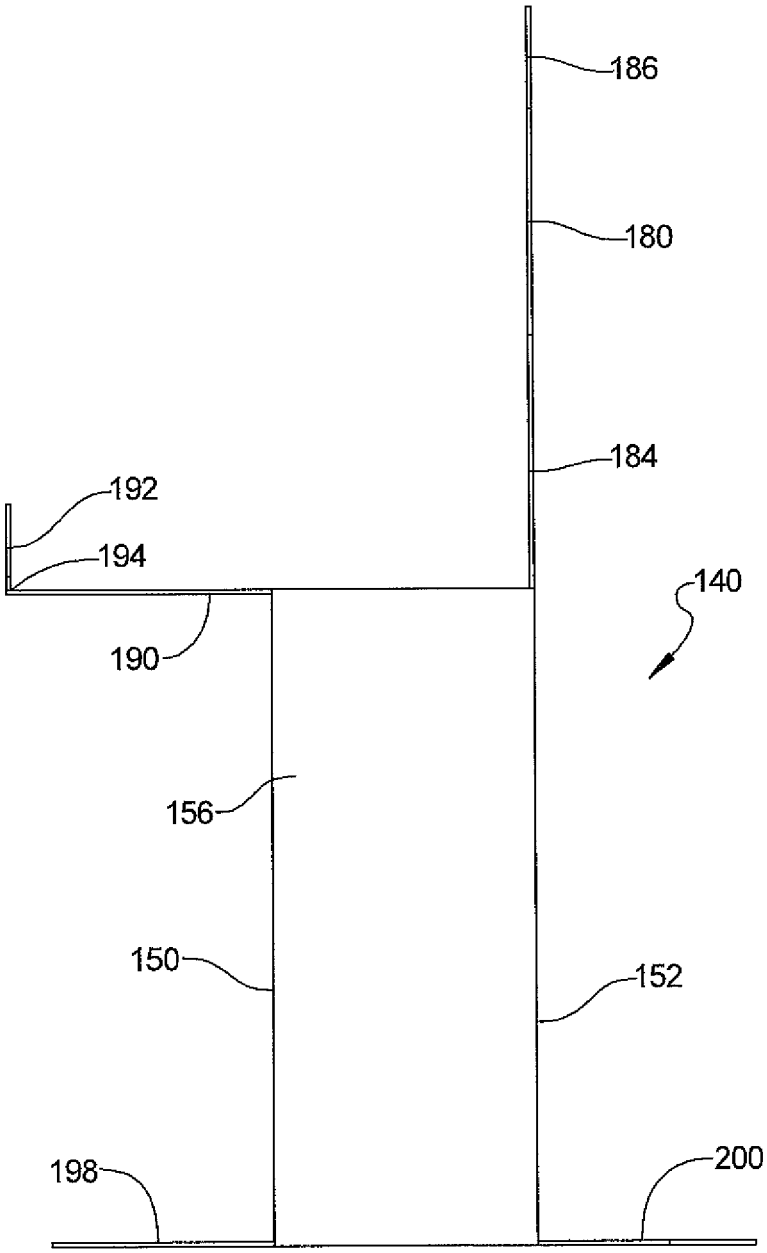
FIG. 12 is a right side view of FIG. 11.

Details of the construction of the outer package 140 are shown in FIGS. 10-15. In FIGS. 11 and 12, the outer container 140 is shown in an open and partially "unfolded" configuration. Left and right top side flaps 170, 172 are extended horizontally from the tops of side walls 154, 156 and left and right bottom side flaps 174, 176 are shown extending horizontally from the bottoms of side walls 154, 156.

The flap 144 of FIG. 10 is shown unfolded in FIG. 11. An upper flap portion 180 is folded forwardly and downwardly over a lower flap portion 182 along a fold line 184 so that tongue portion 186 extends into the container portion 142 (FIG. 10) against the inside of the rear wall 152. As further seen in FIGS. 11 and 12, a front flap 190 includes a tuck tab 192 bent upwardly along bend line 194. As seen in dashed lines in FIG. 10, the tuck tab 192 overlies and presses against the tongue portion 186 of the flap 144 when the outer package 140 is folded closed.

Figure 13:
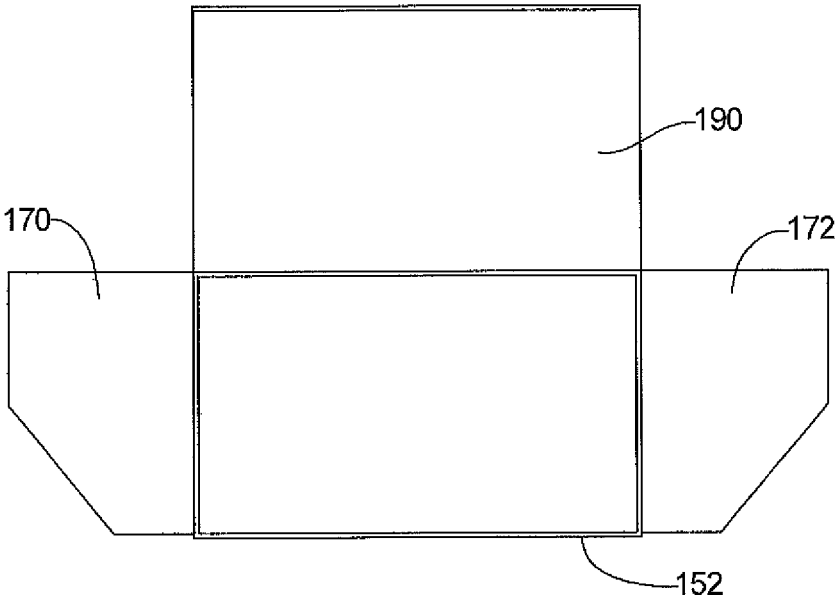
FIG. 13 is a view in section along line 13-13 of FIG. 11.
Figure 14:
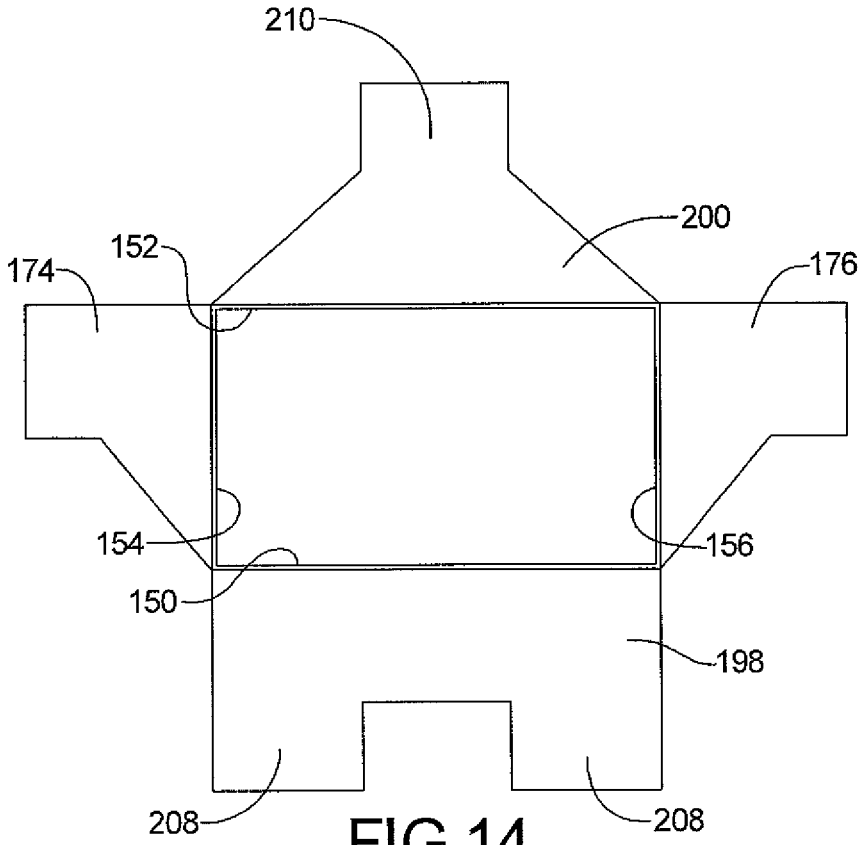
FIG. 14 is a view in section along line 14-14 of FIG. 11.

As further seen in FIG. 12, the outer package 140 further includes a bottom front flap 198 and a bottom rear flap 200. Details of the various flaps are shown in FIGS. 13 and 14. Returning to FIG. 10, the rear wall 152 can be extended laterally and folded forwardly along the inside of wall 154 so as to form a sealing flap 204 extending from the bottom edge to the top edge of side wall 154. The sealing flap 204 can be glued or otherwise fastened to the left side wall 154.

As further seen in FIG. 10, the mounting flap 144 is folded along fold line 184 and its tongue portion 186 is inserted into the container portion 142. The tuck tab 192 (FIG. 11) is then tucked into the top of container 142 so that the front flap 190 forms the top wall 160. In this manner, the top wall 160 is securely held in position. Moreover, the tuck tab 192 presses the tongue portion 186 of the flap 144 against the inside of the rear wall 152 to securely hold the flap 144 in its folded position.

Figure 15:
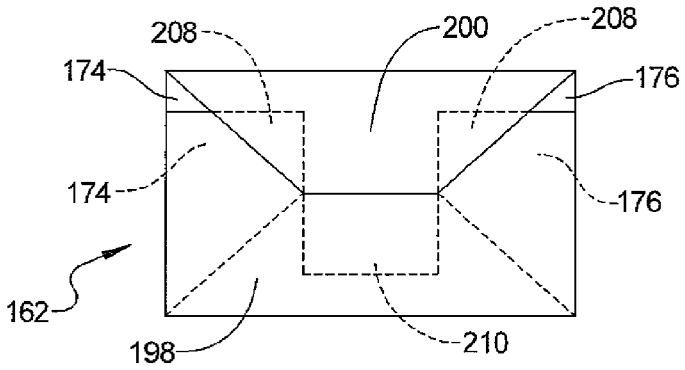
FIG. 15 is a bottom view of FIG. 10.

As seen in FIG. 15, the segmented bottom wall 162 is formed by folding the left and right bottom side flaps 174, 176 inwardly over the bottom of the container portion 142 and then folding the bottom rear flap 200 over the side flaps 174, 176. The arms 208 of the bottom front flap 198 are then inserted between the respective underlying left and fight bottom side flaps 174, 176 and the respective overlying left and right sides of the bottom rear flap 200. The central finger 210 of bottom rear flap 200 is tucked beneath the bottom front flap 198 to hold the segmented bottom wall in an assembled or closed position, as shown in FIG. 15.

In one embodiment, the dimensions of the inner and outer packages 100, 140 are substantially the same and are chosen to match the dimensions of a pocket commonly provided on military and/or law enforcement clothing. It has been found that by dimensioning the width of the front and rear walls 150, 152 of the outer package 140 at about 2⅜ inch (60 mm), the height at about 3⅞ inch (100 mm), the width of the left and right side walls 154, 156 at about 1⅜ inches (35 mm) and at a common height of about 3⅞ inch (100 mm), the outer and inner packages 100, 140, can be conveniently held in many standard sized or commonly sized clothing pockets (with the mounting flap 144 folded back and down against the rear wall 152).

By forming the inner package 100 with substantially the same outer dimensions as the outer package 140, the inner package can be snugly fitted into the container 142 so as to prevent loose movement of the inner package within the outer package so as to prevent or minimize vibration and shock damage to the light assemblies 20. With an inner package 140 dimensioned as set forth above, a series of ten vertically stacked or laddered slots 120 can be uniformly spaced within the inner package. For greater convenience and quicker deployment of one or more light assemblies, the outer package 140 can be removed and only the inner package can be used to carry a series of light assemblies in one's pocket, hand or other holder.

Figure 16:
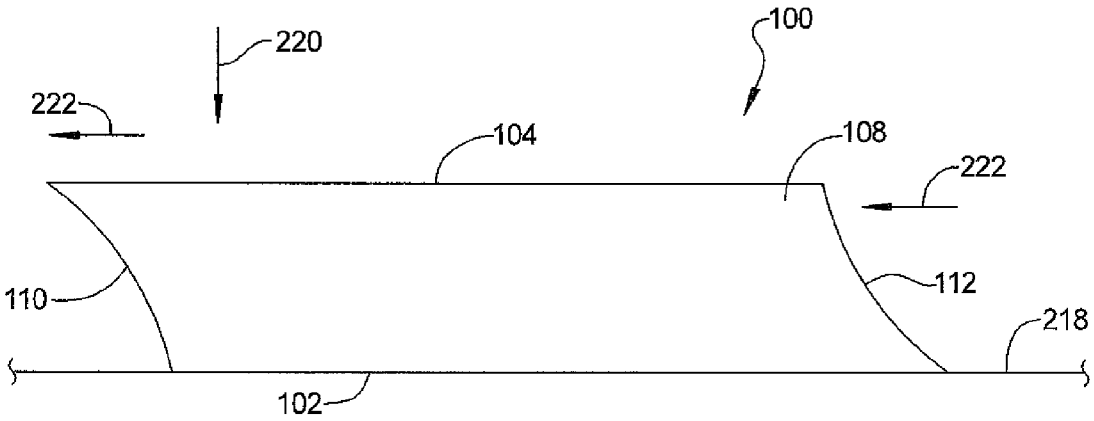
FIG. 16 is a schematic side view of the inner package deformed by a compressive force.

The light assemblies 20, particularly when sealed in a PVC waterproof pouch, are stiffer and more rigid than the inner package so that when they fit snugly within the slots 120, they provide strength and rigidity to the integral assembly of the inner package and light assemblies, yet allow for flexing, such as shown in FIG. 16. That is, the inner and outer packages 100, 140 cooperate with the light assemblies 20 to provide protective strength to the combined assembled packages and light assemblies and are designed as complementary matching components of an integral design. As noted above, the inner and outer packages 100, 140 are dimensioned to fit into a small sleeve or breast pocket and in particular specific to uniforms worn by military members and law enforcement.

Because the inner package sidewalls 106, 108 and top and bottom walls 110, 112 can resiliently bend or flex, particularly when formed with concave recesses 116, the entire package, with the light assemblies 20 held in the slots 120, can deform to prevent damage to the light assemblies 20 when crushing forces are applied to the outer package 140, and/or the inner package 100.

In particular, if a soldier or police office lands hard on their chest or arms, the inner package (and the outer package if present), can easily deform as shown in FIG. 16. This not only protects the light assemblies 20, but also prevents or minimizes injury to the person falling on or bumping against the package. Moreover, accidental light activation is also prevented or minimized.

In FIG. 16, a downward crushing force 220 applied to the rear face 104 of the inner package 100, such as applied by one's body, compresses the inner package against the ground or other surface 218. This results in the distortion of the rectangular profile of the sidewalls of the inner package into a somewhat rhombus-shaped profile as further seen in FIG. 16. The rear portions of both the top and bottom concave faces 110, 112 deflect forwardly as indicated by directional arrows 222.

An advantage of using soft foam material for the inner package 100 is that there is almost no noise produced during any crushing and deflection of the inner package 100 as described above, such as would otherwise be produced by crushing a hard plastic or metal package or case. This virtual silence to the human ear upon crushing is a major advantage to those conducting stealthy operations and who do not wish to give away their location.

It will be appreciated by those skilled in the art that the above packaging for compact light assemblies is merely representative of the many possible embodiments of the invention and that the scope of the invention should not be limited thereto, but instead should only be limited according to the following claims.

What is claimed is:

1. An energy absorbing multicompartment package holding a plurality of light assemblies each having a battery, a light and a light switch comprising a depressible button switch, said energy absorbing multicompartment package protecting said light switch from unintentional activation of said light and comprising a single body of an energy absorbing, crushable, spongy, foamed plastic material formed with a front face, a rear face, a concave top face, a concave bottom face, a concave left side face, a concave right side face and a plurality of slits or slots extending into said single body forming a plurality of compartments within said single body, said plurality of compartments separated by said energy absorbing, crushable, spongy, foamed plastic material, said plurality of light assemblies respectively held in said plurality of compartments with said light switch depressible towards one of said concave top face and said concave bottom face with said energy absorbing material biased against said plurality of light assemblies and covering and protecting each said light switch, and wherein said energy absorbing material prevents said unintentional activation by compression of said energy absorbing material and wherein said energy absorbing material allows quick and easy removal of each of said plurality of light assemblies respectively from each of said plurality of compartments with a push or pull.

2. The energy absorbing multicompartment package of claim 1, wherein said energy absorbing material is selected from the group consisting of a foamed plastic material, paper, cardboard and a nonwoven material.

3. The energy absorbing multicompartment package of claim 1, wherein said energy absorbing material comprises an open cell polyurethane foam material.

4. The energy absorbing multicompartment package of claim 1, wherein said plurality of compartments are arranged in an equally spaced apart series.

5. The energy absorbing multicompartment package of claim 1, wherein said energy absorbing material comprises a spongy material.

6. The energy absorbing multicompartment package of claim 1, wherein said single body of energy absorbing material is formed in a generally rectangular brick shape.

7. The energy absorbing multicompartment package of claim 1, wherein said plurality of light assemblies provide strength and rigidity to said energy absorbing multicompartment package.

8. The energy absorbing multicompartment package of claim 1, wherein said single body is formed with a height of about 100 mm, a width of about 60 mm and a thickness of about 35 mm.

9. The energy absorbing multicompartment package of claim 1, wherein said single body is constructed to deform into a generally rhombus shaped profile along said left and right concave side faces and said top and bottom concave faces when force is applied to said front and rear faces.

10. The energy absorbing multicompartment package of claim 1, wherein said energy absorbing material comprises a soft polyurethane open cell foam material.

11. The energy absorbing multicompartment package of claim 1, wherein said front face and said rear face comprise rectangular faces and said concave top face, said concave bottom face, said concave right side face and said concave left side face each are recessed between said front and rear faces.

* * * * *